US011466896B2

(12) United States Patent
He et al.

(10) Patent No.: US 11,466,896 B2
(45) Date of Patent: Oct. 11, 2022

(54) HEATING BLOWER AND HEATING DEVICE

(71) Applicant: JIANGMEN KEYE ELECTRIC APPLIANCES MANUFACTURING CO., LTD, Jiangmen (CN)

(72) Inventors: Xiangming He, Jiangmen (CN); Guanglian Lin, Jiangmen (CN)

(73) Assignee: JIANGMEN KEYE ELECTRIC APPLIANCES MANUFACTURING CO., LTD, Jiangmen (CN)

( * ) Notice: Subject to any disclaimer, the term of this patent is extended or adjusted under 35 U.S.C. 154(b) by 903 days.

(21) Appl. No.: 16/202,632

(22) Filed: Nov. 28, 2018

(65) Prior Publication Data

US 2020/0072499 A1 Mar. 5, 2020

(30) Foreign Application Priority Data

Aug. 30, 2018 (CN) ..... 201811001616.5

(51) Int. Cl.
*F24H 3/04* (2022.01)
*F04D 27/00* (2006.01)
(Continued)

(52) U.S. Cl.
CPC ..... *F24H 3/0417* (2013.01); *F04D 17/16* (2013.01); *F04D 27/002* (2013.01);
(Continued)

(58) Field of Classification Search
CPC ..... F04D 29/462; F04D 29/464; F24H 9/2064
See application file for complete search history.

(56) References Cited

U.S. PATENT DOCUMENTS 960,815 A * 6/1910 Carlisle ..... F04D 29/462 126/110 A
D152,778 S 2/1949 Fox
(Continued)

FOREIGN PATENT DOCUMENTS

CN 2811632 8/2006
CN 105020159 A 11/2015
(Continued)

OTHER PUBLICATIONS

8-Air VP-25 1 /4 HP 900 CFM Air Mover for Water Damage Restoration Equipment Carpet Dryer Floor Blower Fan Home and Plumbing Use, date first available Mar. 25, 2016, site visited Jun. 29, 2019.

(Continued)

*Primary Examiner* — Courtney D Heinle
*Assistant Examiner* — Andrew J Marien
(74) *Attorney, Agent, or Firm* — Innovation Capital Law Group, LLP; Vic Lin

(57) ABSTRACT

Provided is a heating blower, comprising an air duct, a motor and a wind wheel arranged in the air duct, and a heating device arranged at a first air outlet of the air duct; the wind wheel is fixed to a rotating shaft of the motor; the heating device comprises a housing, an electric heater, a rotary assembly and an air deflector; the housing is sleeved on the first air outlet, forming an inner chamber, which comprises a first area facing directly to the first air outlet and a second area not facing directly to the first air outlet; the electric heater is arranged in one of the first area and the second area; one end of the air deflector is fixedly arranged on the rotary assembly, and the other end of the air deflector rotates with the rotary assembly between the first area and the second area, separating the first area and the second area, so that the
(Continued)

first air outlet is communicated with one of the first area and the second area.

6 Claims, 6 Drawing Sheets

(51) Int. Cl.
*F04D 17/16* (2006.01)
*F04D 29/42* (2006.01)
*F04D 29/46* (2006.01)
*F24H 9/20* (2022.01)

(52) U.S. Cl.
CPC ..... *F04D 29/4246* (2013.01); *F04D 29/462* (2013.01); *F04D 29/464* (2013.01); *F24H 9/2064* (2013.01)

(56) References Cited

U.S. PATENT DOCUMENTS 3,725,640 A 4/1973 Kunz
4,377,107 A 3/1983 Izumi
D269,116 S 5/1983 Armbruster
4,424,006 A 1/1984 Armbruster
4,476,773 A * 10/1984 Fehr ..... F04D 29/462 415/206
4,483,664 A 11/1984 Armbruster
5,048,202 A 9/1991 Shero
5,174,048 A 12/1992 Shero
5,197,112 A 3/1993 Cameron
D340,326 S 10/1993 Genovese
5,265,895 A 11/1993 Barrett
5,555,643 A 9/1996 Guasch
D482,772 S 11/2003 Dooley
6,821,095 B2 11/2004 Dooley et al.
6,950,606 B2 9/2005 Logan et al.
D512,500 S 12/2005 Wilson, Jr.
D512,501 S 12/2005 Wilson, Jr.
D517,677 S 3/2006 Bartholmey
7,050,707 B1 5/2006 Lin
7,088,913 B1 8/2006 Verhoorn et al.
D530,002 S 10/2006 Ching
7,184,655 B2 2/2007 Dehli
D566,823 S 4/2008 Lewis
7,355,146 B2 4/2008 Angelis et al.
D594,962 S 6/2009 Lewis
D596,283 S 7/2009 Martinez et al.
7,664,378 B2 2/2010 Gao
7,699,580 B2 4/2010 Lasko et al.
8,235,686 B2 8/2012 Wark
D687,137 S 7/2013 Nemes
D698,433 S 1/2014 Tomasiak et al.
D704,908 S 5/2014 Cui
8,768,151 B2 7/2014 Tai et al.
9,194,603 B2 11/2015 Yuan et al.
9,395,100 B2 7/2016 Crowe et al.
D810,269 S 2/2018 Sanders et al.
D836,766 S 12/2018 He et al.
D837,360 S 1/2019 Cui
D849,924 S 5/2019 Sanders et al.
11,408,438 B2 8/2022 Lofy et al.
2001/0031137 A1 10/2001 Jones-Lawlor et al.
2004/0047743 A1 3/2004 Dooley et al.
2004/0244962 A1* 12/2004 Tokunaga ..... B60H 1/00664 165/203
2005/0070220 A1* 3/2005 Nagaya ..... B60H 1/00685 454/156
2006/0049615 A1 3/2006 Day
2009/0238687 A1 9/2009 Lin
2016/0175472 A1 6/2016 Tan
2017/0051748 A1 2/2017 He et al.
2018/0209432 A1* 7/2018 Lee ..... F04D 25/08
2019/0128281 A1 5/2019 He et al.

FOREIGN PATENT DOCUMENTS

CN 106225461 A 12/2016
CN 107478047 A 12/2017

OTHER PUBLICATIONS

Stanley 655704 High Velocity Blower Fan, date posted unknown, site visited Jun. 29, 2019, Available from Internet.

* cited by examiner

HEATING BLOWER AND HEATING DEVICE

CROSS REFERENCE TO RELATED APPLICATION

This application claims priority to Chinese Application No. 201811001616.5 having a filing date of Aug. 30, 2018, the entire contents of which are hereby incorporated by reference.

FIELD OF TECHNOLOGY

The following relates to the technical field of blowers, and in particular to a heating blower and a heating device.

BACKGROUND

A blower is a machine that sucks outside air to the interior of the machine through an air inlet and then blows it out from an air outlet. The blower usually has a volute-type body, with the air outlet close to the ground, and can be placed on the ground to dry a wet place. The conventional blower generally comprises a handle, an air duct, a motor and a wind wheel, wherein the air duct is in the shape of a volute; the motor and the wind wheel are disposed inside the air duct; and the air inlet and the air outlet are provided on a lateral side and a front end of the air duct respectively. To blow out warm air, the blower may also be provided with an electric heater therein. The electric heater is usually located inside the air duct, and the motor drives the wind wheel to rotate, so that an outgoing airflow passes through the electric heater and is heated thereby, and then blown out from the air outlet. However, in both a hot air blowing situation and a cold air blowing situation of the conventional blower, the path through which the airflow passes is the same, so that when it needs to blow cold air, the airflow also passes through the electric heater which is not power on, and as the electric heater is usually a metal net, the airflow will be blocked after passing through the metal net, resulting in a small amount of air coming out from the air outlet, and affecting the efficiency; in addition, since the electric heater is disposed in the air duct, the wall of the air duct is also heated during heating, so heat resistance is required for the entire air duct wall.

SUMMARY

Based on this, an objective of the present invention is to provide a heating blower, which has the advantage of switchable airflow path.

A heating blower, comprising an air duct, a motor and a wind wheel arranged in the air duct, and a heating device arranged at a first air outlet of the air duct; the wind wheel is fixed to a rotating shaft of the motor; the heating device comprises a housing, an electric heater, a rotary assembly and an air deflector; the housing is sleeved on the first air outlet, forming an inner chamber, which comprises a first area facing directly to the first air outlet and a second area not facing directly to the first air outlet; the electric heater is arranged in one of the first area and the second area; one end of the air deflector is fixedly arranged on the rotary assembly, and the other end of the air deflector rotates with the rotary assembly between the first area and the second area, separating the first area and the second area, so that the first air outlet is communicated with one of the first area and the second area.

Compared with the known art, in the present invention, the heating device is connected to the outside of the air outlet of the air duct of the blower, and by designing the positional relation between the electric heater and the air outlet of the air duct, an airflow blown from the air outlet of the air duct can switch between a state of passing the electric heater and a state of not passing the electric heater to achieve free switching between blowing hot air and blowing cold air; as compared with the case in which the heating device is arranged inside the air duct, the blower of the present invention can increase the air volume coming out from the air outlet of the air duct when blowing cold air, and can reduce the requirement of high temperature resistance for the overall material of the blower.

Further, the housing comprises a side wall and an end cover, the end cover being parallel to an end face of the first air outlet, one part of the end cover located in the first area being a second air outlet, and another part of the end cover located in the second area being a third air outlet.

Further, the rotary assembly is a rotating shaft, the air deflector is arranged on the rotating shaft and rotates with the rotating shaft.

Further, the heating device further comprises a rotary button, which is arranged on the side wall and is connected to one end of the rotating shaft to drive the rotating shaft to rotate.

Further, a limiting part is provided on an inner wall of the side wall, and the limiting part abuts against the air deflector to fix position of the air deflector; the limiting part comprises a first limiting part and a second limiting part; when the air deflector rotates to the first limiting part, the first air outlet is communicated with the second area; and when the air deflector rotates to the second limiting part, the first air outlet is communicated with the first area.

Further, the heating device further comprises a micro switch connected in series with the electric heater, and the micro switch is arranged in the inner chamber; when the air deflector rotates to the first limiting part, the air deflector abuts against the micro switch, so that the micro switch is powered on; and when the air deflector rotates to the second limiting part, the air deflector does not abut against the micro switch, so that the micro switch is powered off. The micro switch is used for automatic switch between the operation state and the non-operation state of the electric heater. When the micro switch is powered on, a separate power switch of the electric heater is turned on, and the electric heater starts operation; and when the micro switch is powered off, even if the separate power switch of the electric heater is still on, the electric heater does not operate.

The present invention also provides a heating device, comprising a housing, an electric heater, a rotary assembly and an air deflector; the housing is sleeved on a first air outlet of an air duct of a blower, forming an inner chamber, which comprises a first area facing directly to the first air outlet and a second area not facing directly to the first air outlet; the electric heater is arranged in one of the first area and the second area; one end of the air deflector is fixedly arranged on the rotary assembly, and the other end of the air deflector rotates with the rotary assembly between the first area and the second area, separating the first area and the second area, so that the first air outlet is communicated with one of the first area and the second area.

Further, the housing comprises a side wall and an end cover, the end cover being parallel to an end face of the first air outlet, one part of the end cover located in the first area being a second air outlet, and another part of the end cover located in the second area being a third air outlet.

Further, the rotary assembly is a rotating shaft, the air deflector is arranged on the rotating shaft and rotates with the rotating shaft.

Further, the heating device further comprises a rotary button, which is arranged on the side wall and is connected to one end of the rotating shaft to drive the rotating shaft to rotate.

Further, a limiting part is provided on an inner wall of the side wall, and the limiting part abuts against the air deflector to fix position of the air deflector; the limiting part comprises a first limiting part and a second limiting part; when the air deflector rotates to the first limiting part, the first air outlet is communicated with the second area; and when the air deflector rotates to the second limiting part, the first air outlet is communicated with the first area.

Further, the heating device further comprises a micro switch connected in series with the electric heater, and the micro switch is arranged in the inner chamber; when the air deflector rotates to the first limiting part, the air deflector abuts against the micro switch, so that the micro switch is powered on; and when the air deflector rotates to the second limiting part, the air deflector does not abut against the micro switch, so that the micro switch is powered off.

BRIEF DESCRIPTION OF THE DRAWINGS

Some of the embodiments will be described in detail, with references to the following figures, wherein like designations denote like members, wherein.

DETAILED DESCRIPTION

Figure 1:
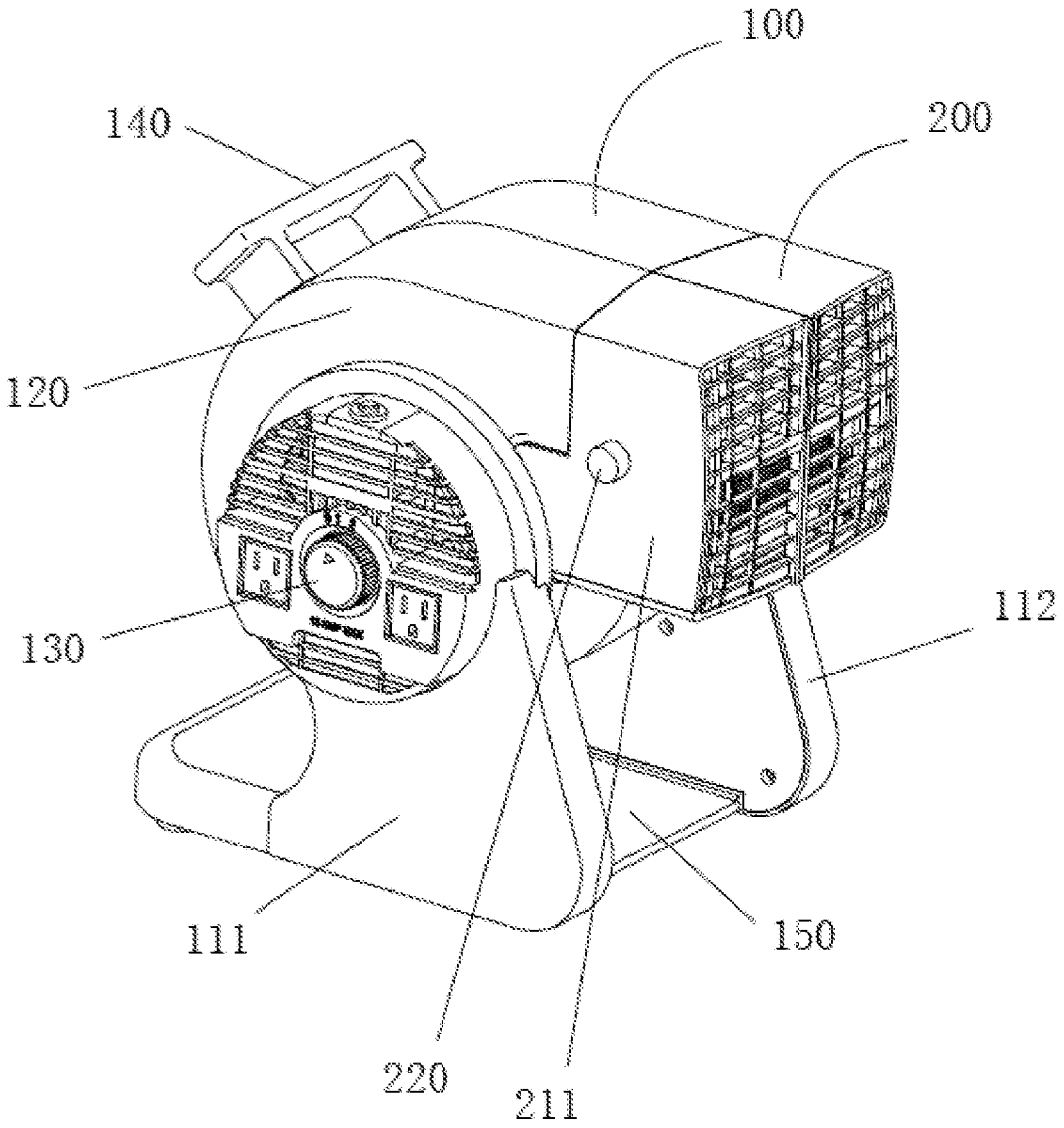
FIG. 1 is a stereoscopic structure diagram of a heating blower of an embodiment.
Figure 2:
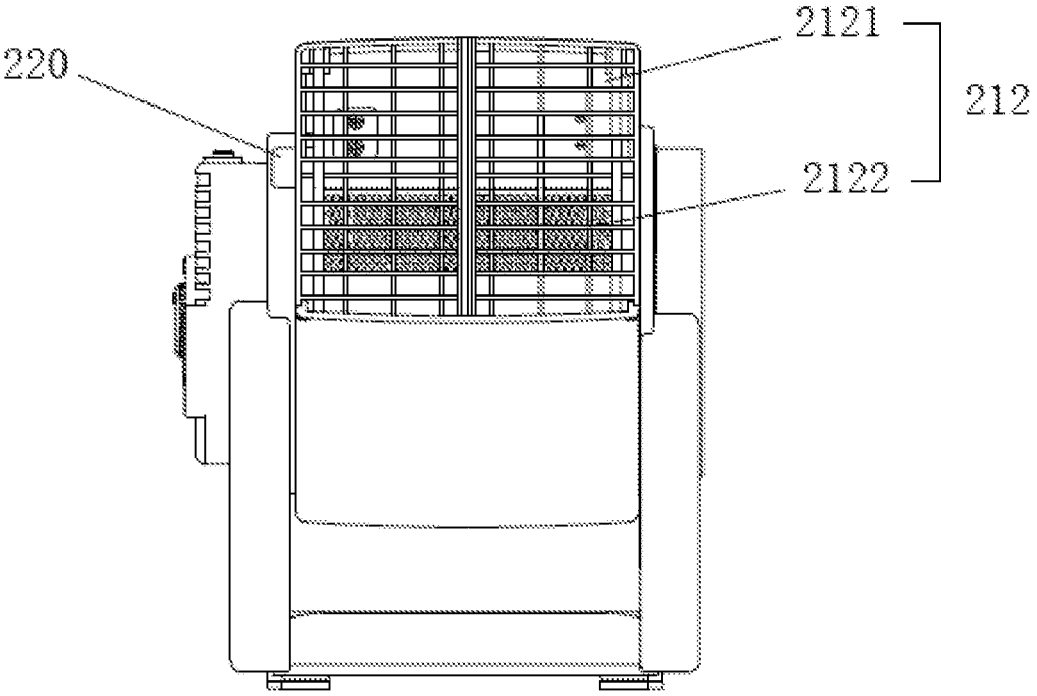
FIG. 2 is a front-view structure diagram of the heating blower of the embodiment.
Figure 3:
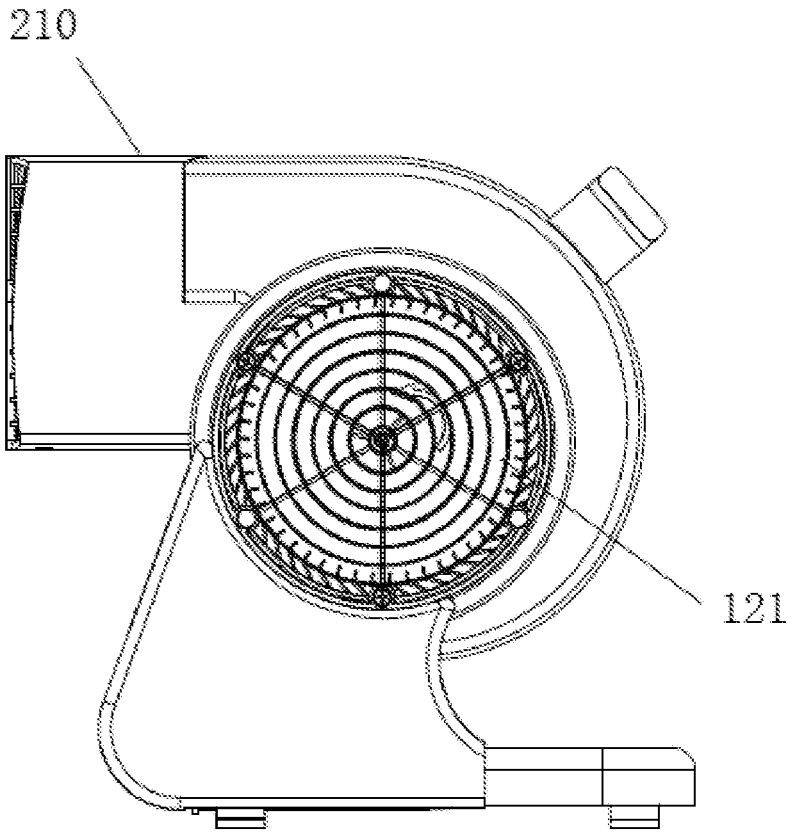
FIG. 3 is a right-view structure diagram of the heating blower of the embodiment.
Figure 4:
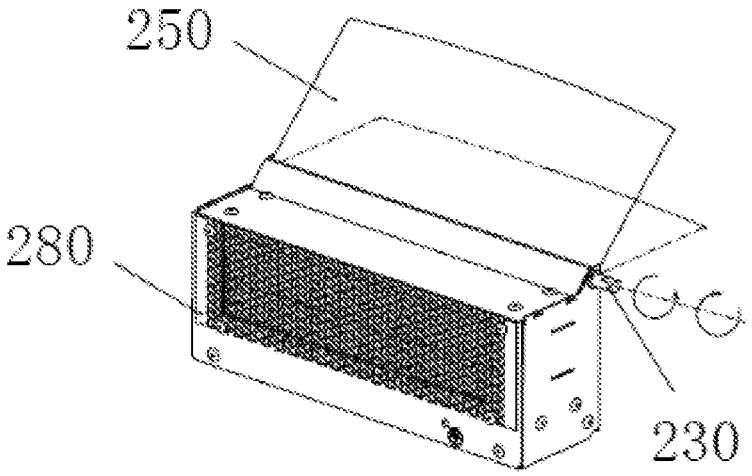
FIG. 4 is a structure diagram of some components of the heating blower of the embodiment.

In the description of embodiments of the present invention, it is to be understood that the orientations or positional relationships, indicated by the terms "center", "longitudinal", "lateral", "upper", "lower", "front", "rear", "left", "right", "vertical", "horizontal", "top", "bottom", "inside", "outside" and the like, are based on the orientations or positional relationships shown in the drawings and are only for the purpose of facilitating and simplifying the description of embodiments of the present invention, rather than indicating or implying that the described device or element must have a particular orientation or must be constructed and operated in a particular orientation, and therefore they cannot to be construed as limiting embodiments of the present invention. In the description of embodiments of the present invention, the meaning of "a plurality of" is two or more, unless otherwise specified.

Refer to FIGS. 1 to 4, which shows a stereoscopic structure diagram, a front-view structure diagram, a right-view structure diagram, and a structure diagram of some components, of a heating blower of the embodiment, respectively.

The heating blower of the embodiment comprises a blower main body device 100 and a heating device 200. The heating device 200 is disposed outside the blower main body device 100.

The blower main body device 100 can adopt any blower main body structure disclosed in the known art. In this embodiment, it comprises a first side wall 111, a second side wall 112, an air duct 120, a motor, a wind wheel, a control assembly 130, a handle 140 and a bottom base 150. The first side wall 111 and the second side wall 112 are disposed oppositely in parallel to each other, and the air duct 120 is disposed between the first side wall 111 and the second side wall 112. Further preferably, the air duct 120 is rotatably disposed between the first sidewall 111 and the second sidewall 112, with the direction of the rotation axis being perpendicular to the first sidewall 111 and the second sidewall 112. The air duct 120 has a hollow volute shape, and comprises a body portion and a front end portion, wherein the motor is installed in the body portion, and the wind wheel is fixed on a rotating shaft of the motor (the motor and the wind wheel are not shown in the figures). The handle 140 is connected to the body portion. The bottom base 150 is arranged below air duct 120 with a distance from the air duct 120, and two sides of the bottom base 150 are connected to the bottoms of the first side wall 111 and the second side wall 112 respectively. The control assembly 130 is installed to a side face of the body portion, and is electrically connected to the motor. The control assembly 130 comprises a control panel and a rotary switch, an auxiliary power socket and a circuit protection device installed on the control panel. An air inlet 121 is provided at another side face of the body portion, and a first air outlet 122 is provided at the front end portion.

The heating device 200 is arranged at the first air outlet 122, and comprises a housing 210, a rotary button 220, a rotary assembly 230, an electric heater 240 and an air deflector 250. The housing 210 is sleeved on the first air outlet 122 and forms an inner chamber, which comprises a first area 2101 facing directly to the first air outlet 122 and a second area 2102 not facing directly to the first air outlet 122. The electric heater 240 is fixedly arranged in one of the first area 2101 and the second area 2102; one end of the air deflector 250 is fixedly arranged on the rotary assembly 230, and the other end of the air deflector 250 rotates in the inner chamber with the rotary assembly 230, and the first area 2101 and the second area 2102 are separated thereby, so that the first air outlet 122 is communicated with one of the first area 2101 and the second area 2102.

The housing 210 comprises a side wall 211 and an end cover 212, the end cover 212 being parallel to an end face of the first air outlet 122, one part of the end cover 212 located in the first area 2101 being a second air outlet 2121, and another part of the end cover 212 located in the second area 2102 being a third air outlet 2122. The rotary button 220 is arranged on the side wall 211, and the rotary assembly 230 is a rotating shaft and is connected to the rotary button 220 at one end. Further preferably, the third air outlet 2122 is located below the second air outlet 2121, and the electric heater 240 is fixedly arranged in the second area 2102.

A limiting part 260 is provided on an inner wall of the side wall 211, and the limiting part 260 abuts against the air deflector 250 to fix the position thereof. In the embodiment, the limiting part 260 comprises a first limit stop 261 and a second limit stop 262. The first limit stop 261 is close to a top end of the first air outlet 122, and fixes one end of the air deflector 250 near the top end of the first air outlet 122, so that the first air outlet 122 and the second area 2102 are communicated to guide an airflow to be blown out from the third air outlet 2122. The second limit stop 262 is close to a bottom end of the first air outlet 122, and fixes one end of the air deflector 250 near the bottom end of the first air outlet 122, so that the first air outlet 122 and the first area 2101 are communicated to guide the airflow to be blown out from the second air outlet 2121.

The heating device 200 further comprises a micro switch 270 connected in series with the electric heater 240, and the micro switch 270 is arranged in the inner chamber. In the embodiment, the micro switch 270 is provided with an elastic sheet. When the air deflector 250 rotates to the first limit stop 261, the air deflector 250 comes into contact with and presses the elastic sheet of the micro switch 270, so that the micro switch 270 is powered on, and when the air deflector 250 rotates to the second limit stop 262, the elastic sheet bounces up, so that the micro switch 270 is powered off.

The heating device 200 further comprises a protective net 280 disposed in the inner chamber and mounted on the electric heater 240.

Figure 5:
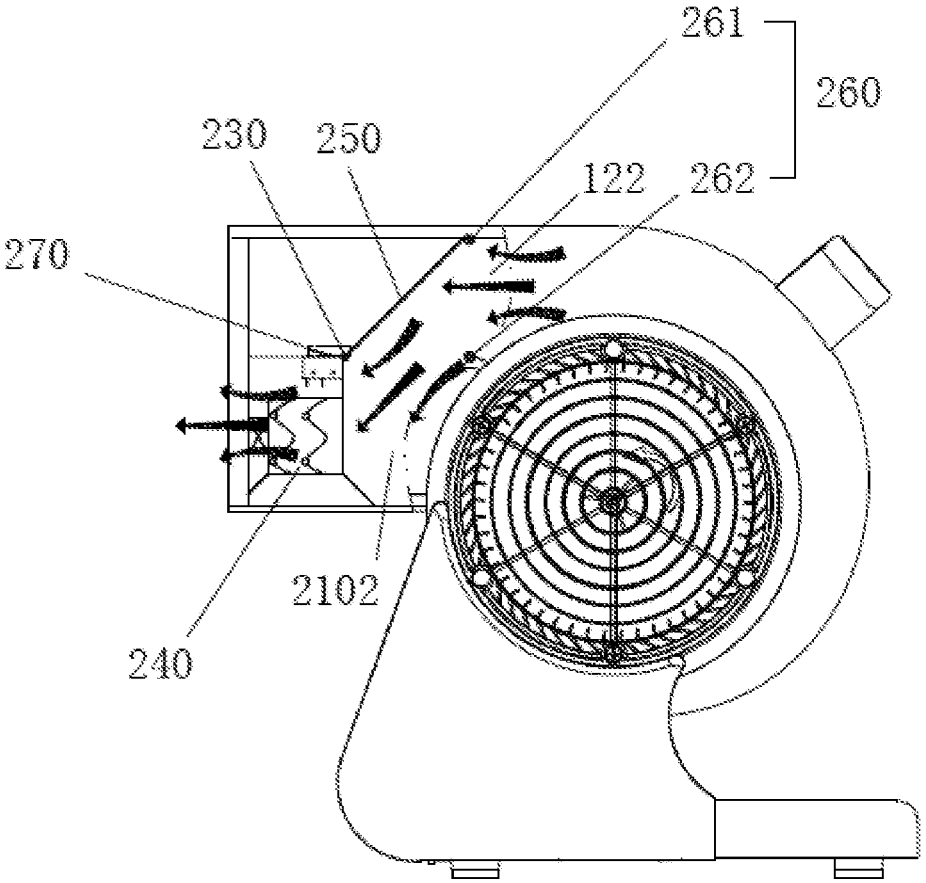
FIG. 5 is a schematic diagram of the heating blower of the embodiment in a heating state during operation.
Figure 6:
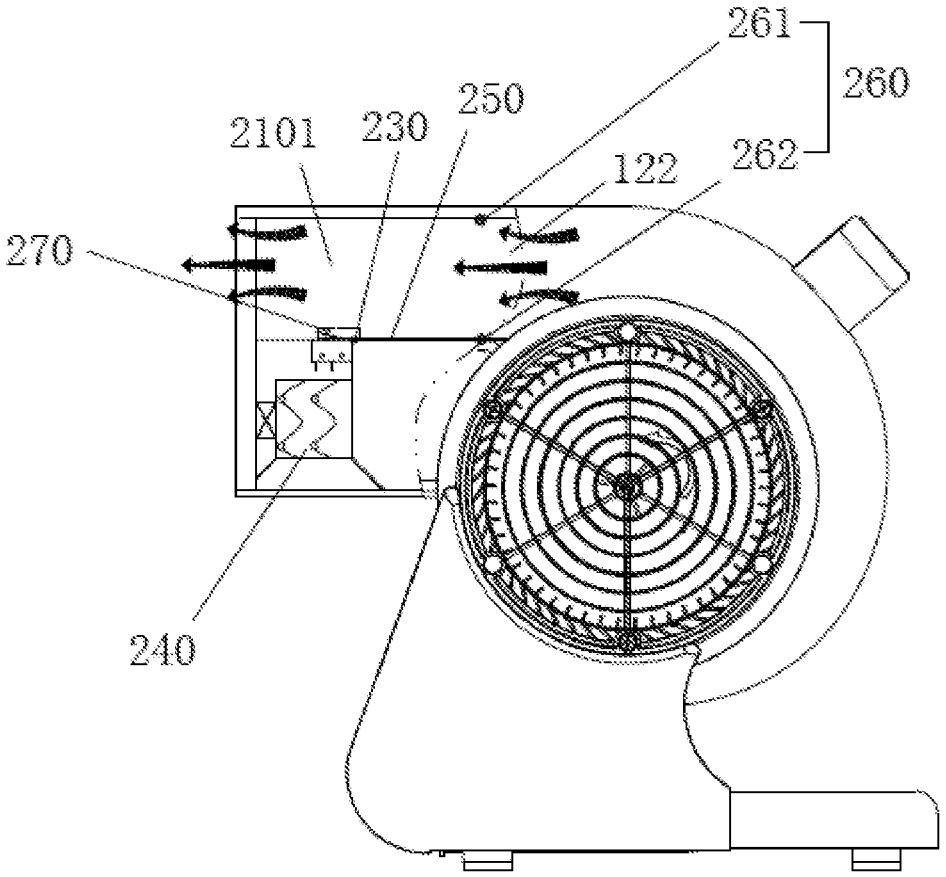
FIG. 6 is a schematic diagram of the heating blower of the embodiment in a normal state during operation.

Refer to both FIG. 5 and FIG. 6, which shows a schematic diagram of the heating blower of the embodiment in a heating state during operation and a schematic diagram of the heating blower in a normal state during operation, respectively. In the heating state, the air deflector 250, driven by the rotary button 220, rotates upward with a rotating shaft 230 to the first limit stop 261, and at that time, the micro switch 270 is powered on, and a separate power switch of the electric heater 240 is turned on, the electric heater 240 starts operation, the airflow blown from the first air outlet 122 passes through the electric heater 240 and is heated thereby, and then hot air is blown from the third air outlet 2122. In the normal state, the air deflector 250, driven by the rotary button 220, rotates downward with the rotating shaft 230 to the second limit stop 262, and at that time, the micro switch 270 is powered off, and even if the separate power switch of the electric heater is still on, the electric heater 240 does not operate, the airflow blown from the first air outlet 122 is not heated by the electric heater 240 and directly passes through the first area 2101, and then cold air is blown from the second air outlet 2121, wherein the cold air here refers to room-temperature air. Thus, the operation state and the non-operation state of the electric heater can be switched by the micro switch.

Compared with the known art, in the present invention, the heating device is connected to the outside of the air outlet of the air duct of the blower, and by designing the positional relation between the electric heater and the air outlet of the air duct, an airflow blown from the air outlet of the air duct can switch between a state of passing the electric heater and a state of not passing the electric heater to achieve free switching between blowing hot air and blowing cold air; as compared with the case in which the heating device is arranged inside the air duct, the blower of the present invention can increase the air volume coming out from the air outlet of the air duct when blowing cold air, and can reduce the requirement of high temperature resistance for the overall material of the blower.

Although the invention has been illustrated and described in greater detail with reference to the preferred exemplary embodiment, the invention is not limited to the examples disclosed, and further variations can be inferred by a person skilled in the art, without departing from the scope of protection of the invention.

For the sake of clarity, it is to be understood that the use of "a" or "an" throughout this application does not exclude a plurality, and "comprising" does not exclude other steps or elements.

What is claimed is:

1. A heating blower, comprising an air duct, a motor and a wind wheel arranged in the air duct, and a heating device arranged at a first air outlet of the air duct; wherein the wind wheel is fixed to a rotating shaft of the motor; the heating device comprises a housing, an electric heater, a rotary assembly, an air deflector and a micro switch; the housing is sleeved on the first air outlet, forming an inner chamber, which comprises a first area facing directly to the first air outlet and a second area not facing directly to the first air outlet; the electric heater is arranged in the second area; one end of the air deflector is fixedly arranged on the rotary assembly, and the other end of the air deflector rotates with the rotary assembly between the first area and the second area, separating the first area and the second area, so that the first air outlet is communicated with one of the first area and the second area;

wherein the housing comprises a side wall and an end cover, the end cover being parallel to an end face of the first air outlet, one part of the end cover located in the first area being a second air outlet, and another part of the end cover located in the second area being a third air outlet; a limiting part is provided on an inner wall of the side wall, and the limiting part abuts against the air deflector to fix position of the air deflector; the limiting part comprises a first limiting part and a second limiting part; when the air deflector rotates to the first limiting part, the first air outlet is communicated with the second area; and when the air deflector rotates to the second limiting part, the first air outlet is communicated with the first area;

wherein the micro switch is connected in series with the electric heater, and is arranged in the inner chamber; when the air deflector rotates to the first limiting part, the air deflector abuts against the micro switch, so that the micro switch is powered on; and when the air deflector rotates to the second limiting part, the air deflector does not abut against the micro switch, so that the micro switch is powered off.

2. The heating blower according to claim 1, wherein the rotary assembly is a rotating shaft, the air deflector is arranged on the rotating shaft and rotates with the rotating shaft.

3. The heating blower according to claim 2, wherein the heating device further comprises a rotary button, which is arranged on the side wall and is connected to one end of the rotating shaft to drive the rotating shaft to rotate.

4. A heating device, comprising a housing, an electric heater, a rotary assembly, an air deflector and a micro switch; wherein the housing is sleeved on a first air outlet of an air duct of a blower, forming an inner chamber, which comprises a first area facing directly to the first air outlet and a second area not facing directly to the first air outlet; the electric heater is arranged in the second area; one end of the air deflector is fixedly arranged on the rotary assembly, and the other end of the air deflector rotates with the rotary assembly between the first area and the second area, separating the first area and the second area, so that the first air outlet is communicated with one of the first area and the second area;

wherein the housing comprises a side wall and an end cover, the end cover being parallel to an end face of the first air outlet, one part of the end cover located in the first area being a second air outlet, and another part of the end cover located in the second area being a third air outlet a limiting part is provided on an inner wall of the side wall, and the limiting part abuts against the air deflector to fix position of the air deflector; the limiting part comprises a first limiting part and a second limiting part; when the air deflector rotates to the first limiting part, the first air outlet is communicated with the second area; and when the air deflector rotates to the second limiting part, the first air outlet is communicated with the first area;

wherein the micro switch is connected in series with the electric heater, and is arranged in the inner chamber; when the air deflector rotates to the first limiting part, the air deflector abuts against the micro switch, so that the micro switch is powered on; and when the air deflector rotates to the second limiting part, the air deflector does not abut against the micro switch, so that the micro switch is powered off.

5. The heating device according to claim 4, wherein the rotary assembly is a rotating shaft, the air deflector is arranged on the rotating shaft and rotates with the rotating shaft.

6. The heating device according to claim 5, further comprising a rotary button, which is arranged on the side wall and is connected to one end of the rotating shaft to drive the rotating shaft to rotate.

* * * * *